US009462894B2

(12) United States Patent
Whiting et al.

(10) Patent No.: US 9,462,894 B2
(45) Date of Patent: Oct. 11, 2016

(54) CHILD CARRIER

(71) Applicants: Juliette Whiting, Southampton (GB); Sharon Cave, Southampton (GB)

(72) Inventors: Juliette Whiting, Southampton (GB); Sharon Cave, Southampton (GB)

( * ) Notice: Subject to any disclaimer, the term of this patent is extended or adjusted under 35 U.S.C. 154(b) by 0 days.

(21) Appl. No.: 14/433,550

(22) PCT Filed: Oct. 7, 2013

(86) PCT No.: PCT/GB2013/052608

§ 371 (c)(1),
(2) Date: Apr. 3, 2015

(87) PCT Pub. No.: WO2014/053862

PCT Pub. Date: Apr. 10, 2014

(65) Prior Publication Data

US 2015/0257544 A1 Sep. 17, 2015

(30) Foreign Application Priority Data

Oct. 5, 2012 (GB) ..... 1217830.7
Jan. 14, 2013 (GB) ..... 1300600.2

(51) Int. Cl.
*A47D 13/02* (2006.01)
*A47D 15/00* (2006.01)

(52) U.S. Cl.
CPC ..... *A47D 13/02* (2013.01); *A47D 13/025* (2013.01); *A47D 15/005* (2013.01)

(58) Field of Classification Search
CPC ... A47D 13/02; A47D 13/025; A47D 15/005
USPC ..... 224/159–161; 297/254
See application file for complete search history.

(56) References Cited

U.S. PATENT DOCUMENTS

| | | | | |
|---|---|---|---|---|
| 4,324,430 | A | 4/1982 | Dimas, Jr. et al. | |
| 5,002,338 | A | 3/1991 | Gisser | |
| 5,143,420 | A | 9/1992 | Switlik | |
| 5,224,229 | A | 7/1993 | Smith | |
| 5,673,969 | A | 10/1997 | Frazier | |
| 8,484,782 | B2 * | 7/2013 | Garofalo | A47D 13/083 297/250.1 |

FOREIGN PATENT DOCUMENTS

| | | |
|---|---|---|
| GB | 0722684 | 7/1996 |
| GB | 2350560 | 12/2000 |
| SE | WO2011071441 | 6/2011 |

* cited by examiner

*Primary Examiner* — Corey Skurdal
(74) *Attorney, Agent, or Firm* — Ober, Kaler, Grimes & Shriver; Royal W. Craig

(57) ABSTRACT

The present invention relates to a child carrier comprising: a child harness mounted on a backboard (2) that is rigid at least in part. The backboard (2) comprises at least one fastening (1) arranged in use to attach the carrier to a user in a seat restraint.

9 Claims, 1 Drawing Sheet

CHILD CARRIER

FIELD OF THE INVENTION

The present invention relates to a child carrier and more particularly but not exclusively a child carrier for use in a car as an alternative to a child seat to serve as a safety restraint for the child.

BACKGROUND

Whilst travelling with children in a vehicle it is important that the children are correctly strapped in place.

The rules governing types of strapping provisions required for children whilst travelling vary in different countries.

In some countries a child must travel in a child seat, whereas in others a small child may be legally carried in the arms of the parent. Some countries also specify a direction in which children of certain weights or heights should face whilst travelling and in what position in the car they may be placed for example in the passenger seat or back seat therefore the equipment required may vary from place to place.

Parents or carers, or users, are always keen to provide the highest safety measures possible for their children however the varying laws in different countries may mean that they cannot always guarantee that their preferred travel arrangements will be available or that they will have the necessary equipment with them Also when abroad and particularly when travelling, it may not always be viable or possible to carry a home-standard child seat and therefore an alternative must be sought.

The present invention therefore arose in order to overcome problems associated with travelling with children in vehicles when standardised child travel arrangements are not available, and a user desires a standardised or familiar arrangement the user can trust; particularly where no arrangements for children are not feasible or are unavailable and a user does not feel comfortable or needs reassurance.

Granted U.S. Pat. No. 7,618,097 (GHATGE) discloses a vehicle seat belt guide comprising a support body having at least one anchor position and a belt diverter supported by and selectively positionable relative to the support body, said support body being of a substantially elongated form and substantially rigid, the or each said anchor position of the support body being adapted in use to engage with and be supported by a support member extending from a vehicle seat back to a headrest and said support body comprising a guide formation which extends along at least a part of the length of the elongate support body whereby, in use, and with the support body extending substantially perpendicular to the normal direction of travel of the vehicle, the seat belt diverter is movable laterally relative to the direction in which the support member extends from a vehicle seat back to a headrest, the seat belt guide further comprising clamping means to secure the belt diverter in a required position relative to the support body.

U.S. Pat. No. 3,769,938 (HUDZIAK) discloses an infant's garment having an elongated shirt like body, said shirt like body comprising a covering for the shoulders and torso of an infant including a front side and a back side, said shirt like body having a neck opening at one end and a crotch portion in the other end, manually releasable snap means joined to said other end for attaching said crotch portion to a mating ring member that is joined to the shirt like body below said neck opening near the center of the back side of said garment, means for enlarging the neck opening to allow passage of the infant's head therethrough and for thereafter closing the neck opening, a pair of waist encircling band portions, each of said waist encircling band portions being attached to opposite sides of the front side and the back side of said garment at the central portion of said garment for securing the garment around the waist of the infant, and means comprising a pair of snap connected leashes attached to said waist encircling band portions for tying the infant in place.

Granted European patent EP 1 565 091 (BERGKVIST) discloses a child harness that includes a child carrying pouch which is positioned on the front side of the harness, so as to be supported on the chest side of the wearer, and that further includes two strap loops which pass around respective shoulders of the wearer, wherein the loops are mutually fastened by means of a fastener means on the rear side of the harness, characterised in that the strap of each loop has a longitudinally extending thickened edge on the mutually adjacent edges of the loops on the rear side of the harness; and in that the fastener means has along each of two opposite edges an undercut groove which slidingly receives a respective edge thickening of the adjacent strap loops, therewith allowing the fastener means to slide along the straps of the loops.

In contrast the present invention provides a highly portable and flexible means of providing child safety in a myriad of vehicles both with arrangements for child safety and with none, and more particularly provides a safety conscious, portable and simple-to-use alternative to as user simply holding baby on their lap whenever a dedicated infant seat is not available.

SUMMARY

According to the present invention there is provided a child carrier for transporting a child in a car comprising: a child harness mounted on a backboard that is rigid at least in part, said backboard comprising at least one fastening arranged in Use to attach the carrier to a user in a seat restraint. The harness comprises two belts arranged in use to pass over the child's shoulders, one for each arm, two belts to secure around the child's waist, and a belt between the child's legs.

BRIEF DESCRIPTION OF FIGURES

The drawings show one embodiment of the invention given by way of example only, in which.

DETAILED DESCRIPTION OF FIGURES

Figures 1, 2:
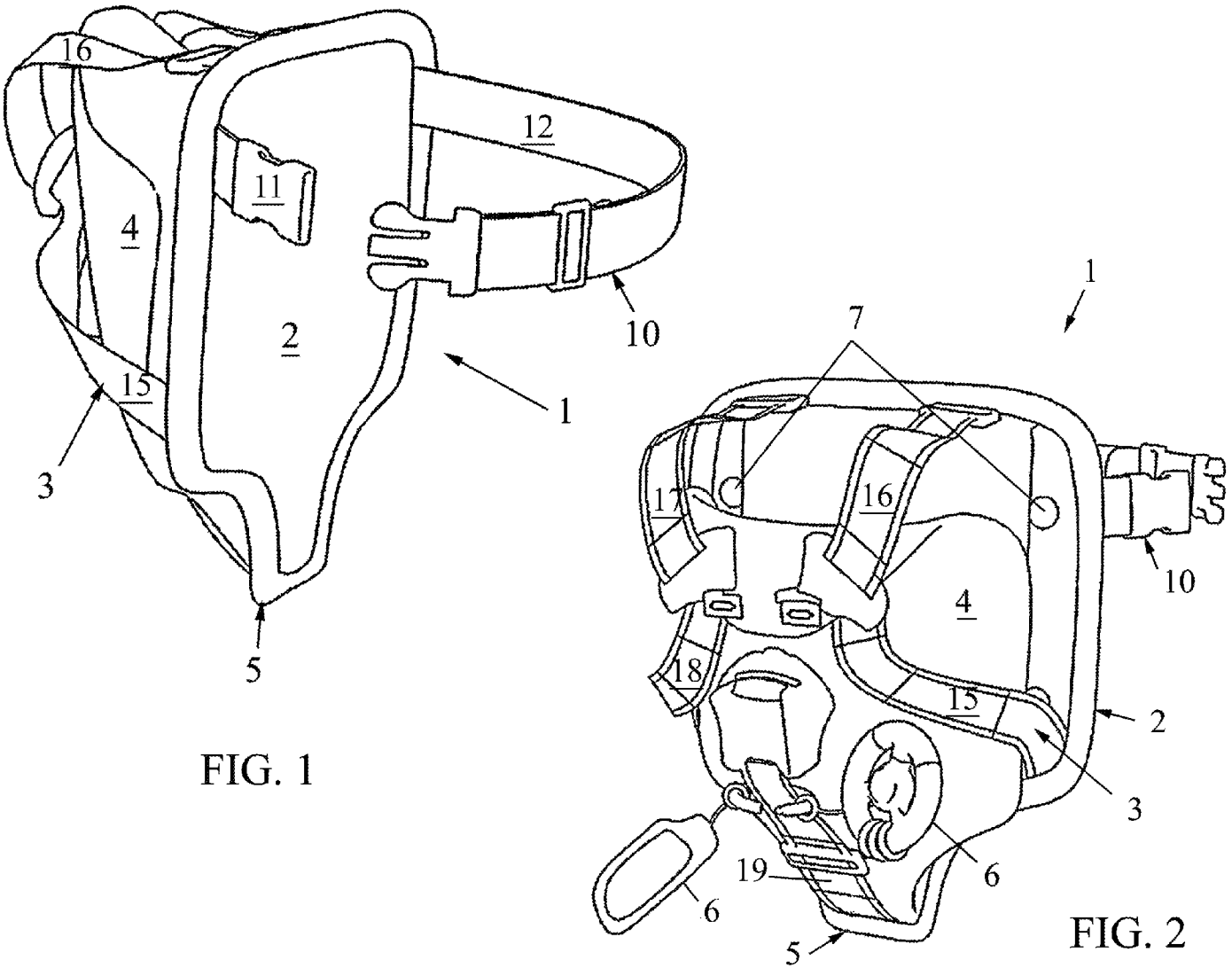
FIG. 1 shows an isometric view from rear of a preferred embodiment of the carrier.
FIG. 2 shows an isometric view from front of the embodiment of FIG. 1.

According to the present invention there is provided a child carrier 1 comprising a child harness 3 mounted on a backboard 2 that is rigid at least in part, said backboard 2 comprising at least one fastening 10 arranged in use to attach the carrier 1 to a user in a seat restraint.

The pictured embodiment comes with attachment means 6 to which toys can be connected to entertain the child to make an attractive piece of baby equipment. Child carrier 1 generally includes the following:

Fastening 10 comprising strapping

Backboard 2

Child harness 3 comprising belts
Pouch 4 stitched at bottoms
Tapered lower backboard section 5
Loop 6 for Toys
Poppers for restraint padding 7
Strapping length alteration means 8

The backboard 2 may be composed of at least two layers, for example at least two plies, in order to allow the backboard 2 to be held in use in place against the user by a car seat restraint. Said layers may be permanently or temporarily fastened together, for example wherein in some further embodiments one layer may be flexible or resiliently deformable and/or embodied in or supported by an item of clothing.

A first layer or ply or child facing portion therefore supports or comprises the harness 3. A second layer or ply or user facing portion of the backboard 2 supports or comprises the at least one fastening 10; such that the harness is 3 arranged in use to hold the child and the fastening 10 is arranged in use to secure the carrier 1 to the user, wherein said user is in use held in place in a vehicle.

The blackboard may be of thickness between 0.8 cm and 1.2 cm.

The child carrier 1 enables the child to be carried in a vehicle or more particularly and additionally the carrier 1 to be secured to the user in a vehicle, wherein said user is strapped into a standard vehicle seat restraint or seatbelt so as to enable the user to support the child in conjunction with the restraint, when travelling in a vehicle without a child seat. Therefore travelling in all vehicles may be facilitated through a standardized portable solution.

Typically the fastening 10 is separately openable to/from the restraint and comprises at least one strap 11, 12 attached to the backboard 2 in more than one location, which straps 11, 12 are arranged in use to encircle the user. Such strapping 11, 12 serves as a means of helping attach the backboard 2 and/or carrier to the user and in separate operation serves to aid in or facilitate attachment of the carrier to the user, for example wherein the strapping 11, 12 is attached to the user prior to seating and using the carrier 1 or wherein the child is secured into the carrier 1, user sits in the seat, secures the seat restraint and subsequently operates the fastening 1 by passing the strapping 11, 12 around the user and/or seat restraint.

In preferred embodiments the backboard 2 of the child carrier 1 is arranged in use to be positioned against the user's chest. The strapping 11, 12 is arranged in use to secure the backboard 2 to the user by passing around the user's body, for example back, waist and/or legs.

In preferred embodiments the strapping 11, 12 can be separated for example parted, passed around the user and then fastened so as to attach the backboard 2 to the user. The strapping 11, 12 is advantageously arranged to be alterable in length so as to accommodate plural user body shapes.

In some embodiments the fastening 10 may include two shoulder straps with an optional waist band to secure the backboard 2 to the user. Such multi-point strapping arrangements may include single or multiple attachment or securement to the user.

In further embodiments the fastening 10 may encompass a means of fastening or securing the backboard 2 or carrier to the restraint in addition or the alternative, for example wherein the fastening 10 comprises at least one and preferably two hooks, catches or stays which stays act to fasten the restraint to the backboard 2 or carrier 1. Said stays may be affixed onto the restraint directly wherein the carrier 1 is prevented from movement in a plurality of directions with reference to the user or restraint. For example the stays may be arranged to fasten to at least two sections of the restraint, wherein at least one of said sections, typically uppermost and diagonal in use, may be semi-permanently fastened, and another temporary slip-over, or only when the carrier 1 is in use, so as to secure the carrier 1 with reference to a horizontal section.

In some embodiments the harness 3 may be separate or separable from the backboard 2, for example wherein an easy securement means is provided such as click fit or at least one resiliently deformable catch. In this way the harness 3 may be detachable from the backboard 2, wherein the backboard 2 may be left in place on the restraint, typically fastened to an upper restraint section.

In preferred embodiments the backboard 2 is shaped so as to include a tapered lower portion 5 arranged in use to rest comfortably between the user legs, and/or act as a pivot point to tip the backboard 2 forward to allow passage of the restraint and/or closure of the fastening 10.

The backboard 2 is ideally includes a reinforced and/or padded portion which is arranged to support the harness 3 with child in use and is padded or deformable on both sides for comfort of the user and the child. Advantageously the backboard 2 is also rigid where appropriate so as not to fold and crush the child should it be subjected to force from an impact. Said padding or deformation may advantageously also act to absorb pressures during impact, for example such as where the user is pressed against the backboard 2, for example should said backboard 2 be primarily or solely fastened to the restraint.

In preferred embodiments the harness 3 has five adjustable belts 15-19 that each attach to a separate location on the backboard 2. Ideally each belt 15-19 is secured to the backboard 2 so as to provide a strong point of attachment for the harness 3.

Preferably the backboard 2 is a supporting structure to which the harness 3 is attached and includes structural reinforcement between locations of attachment.

Typically the carrier 1 may include two belts 16, 17 arranged in use to pass over the child's shoulders, one for each arm, two belts 15, 18 secure around the child's waist and one belt 19 between the child's legs. The belts 15-19 may be arranged in use such that all the belts 15-19 connect to one main buckle 20 to form the harness 3.

In preferred embodiments the backboard 2 further comprises a pouch 4. The pouch 4 may be a pocket with leg holes in which the child can be seated. Said pouch 4 may be attached in use to the belts 15-19, internally or externally, permanently or temporarily. Preferably the pouch 4 is permanently attached at least on the tapered section of the backboard 2 allowing the pouch 4 to flap open. This allows the pouch 4 to be easily cleaned and the child to be easily placed into the pouch 4.

Typically in use the backboard 2 may be arranged to be attached to the user by the fastening 10 or strapping 11, 12 as described above. In this way in some embodiments the carrier 1 may be able to be and desirable to be used as a standard carrier in general use.

Upon entering a vehicle, the vehicle seat restraint is subsequently positioned over the user; and in some embodiments may be passed over or through the backboard 2 so as to connect the backboard 2 to the restraint. In such embodiments therefore the backboard 2 is held to the user by the strapping 11, 12 and the restraint when use. In preferred embodiments the restraint is merely passed over and around the user which may be accomplished with the carrier in place, wherein for example the fastening 10 including strapping 11, 12 may be displaced or detached to allow passage of the restraint in use on at least one side of the user and carrier 1.

In some embodiments the backboard 2 may therefore include at least one guide loop as additional fastening to guide and secure the restraint in a preferred position. Ideally the loops may be opened to allow the restraint to pass through and then closed around the restraint to hold it in position.

In preferred embodiments the carrier includes a padded layer that covers the restraint and/or backboard 2 in use so as to not rub or pinch the child. Ideally the padded layer may be removable so as to be easily washed if required and may accordingly be secured by temporary means such as press studs or poppers 7, buttons, zippers, or hook and loop.

In embodiments with the pouch 4, once the restraint is in place the pouch 4 may then be raised from its open position and attached to the backboard 2. Preferably the pouch 4 is lifted from its open position and is removably attached to the backboard 2 by a plurality of poppers 7 although it is envisaged that other forms of attachment such as hooks, buckles, clips, clasps or hook and loop attachment such as Velcro™ may be used.

In some countries the direction that the child should face when being transported in the vehicle is legislated.

In order therefore to accommodate both orientations said pouch 4 may include a head support that cups or supports the back of the child's head whilst travelling seated backwards but that can be folded down and secured in place, typically by a popper 7, to allow space for the face of the child when travelling forwards.

Preferably the pouch 4 is formed of a strong, durable, lightweight, breathable fabric. Ideally the pouch 4 is padded for comfort and so as to provide support for the child but is not rigid or not wholly rigid so that the pouch 4 may be easily displaced and/or stowed when not in use.

In some preferred embodiments the harness 3 belts 15-19 may accept or be arranged with a removable loop 6 for holding toys so that the child can play whilst travelling. Preferably the loop 6 may attach to the buckle or an outward facing area of the belts 15-19 so as not to rub the child in use. In some embodiments the loop 6 may encompass the harness belts 15-19.

Typically the at least one loop 6 is openable so as to allow the attachment and removal of toys to the loop 6.

Some embodiments are able to be rolled or folded and therefore easily transportable, for example wherein the backboard 2 may include living hinges and/or at least one one-way fold. For example in some embodiments the harness 3 may be detachable from the backboard 2 and the backboard 2 rolled up with plural one-way folds allowing the backboard 2 to roll up on the child face, and for example the harness 3 or fastening 10 being used to secure the backboard 2 for storage or transport.

The carrier 1 may be arranged to be placed in a stored condition which has an essentially flat or squat spatial envelope.

In preferred embodiments the backboard 2 remains rigid where appropriate at all stages and the carrier 1 is transported or stored in a backpack or case.

The carrier 1 may be provided with an attachment for a strap or a (integral or removable) strap, which allows an adult to carry the child in the carrier 1 when not in the vehicle.

The invention has been described by way of examples only and it will be appreciated that variation may be made to the above-mentioned embodiments without departing from the scope of invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A child car safety carrier for transporting a child in a car comprising:

a backboard that is rigid at least in part, said backboard having one side comprising a first surface arranged to be positioned against a user's chest, and another side comprising a second surface arranged to be positioned against a child's back, the first surface and second surface being opposing surfaces of said backboard, and the backboard being shaped with a tapered lower section configured to conform to and rest comfortably between a user's legs when in use;

at least one fastening arranged on said one side of said backboard for attaching the carrier to a user when said user is secured in a seat restraint of said car;

a harness comprising two belts arranged in use on another side of said backboard and configured to pass over the child's shoulders, one for each arm, and said harness further comprising two belts attachable together to secure around the child's waist, and a belt between the child's legs.

2. A carrier according to claim 1 wherein the fastening is selectively attachable to the seat restraint and the fastening comprises strapping attached to the backboard in more than one location.

3. A carrier according to claim 1 wherein the fastening comprises means for securing at least a part of the seat restraint of said car with the carrier.

4. A carrier according to claim 1 wherein the backboard includes a padded tab that is arranged in use to cover the restraint so as to not rub or pinch the child.

5. A carrier according to claim 4 further comprising as pouch secured to said backboard and arranged in use to receive a child.

6. A carrier according to claim 5 wherein the pouch is detachable from the backboard.

7. A child car safety carrier for transporting a child in a car comprising:

a padded backboard that is substantially rigid, said backboard having one side comprising a first surface arranged to be positioned against a user's chest, and another side comprising a second surface arranged to be positioned against a child's back, the first surface and second surface being opposing surfaces of said backboard, and the backboard being shaped with a tapered lower lap section configured to conform to and rest comfortably between a user's legs when in use;

a fastening attached on one side of said backboard for attaching the carrier to a user when said user is secured in a seat restraint of said car;

a harness comprising a plurality of belts all attached at one end to another side of said backboard, a first pair of said plurality of belts being, configured to pass over the child's shoulders, a second pair of said plurality of belts being attachable together around the child's waist, and a fifth belt passing between the child's legs.

8. A carrier according to claim 7 wherein the fastening comprises a pair of selectively closable belts attached on opposing ends on said one side of said backboard.

9. A carrier according to claim 7 further comprising a pouch secured to said backboard and arranged in use to receive a child.

* * * * *